US006286681B1

(12) United States Patent
Wilfong, Jr. et al.

(10) Patent No.: US 6,286,681 B1
(45) Date of Patent: Sep. 11, 2001

(54) VENTILATED PLASTIC BAG

(75) Inventors: Harry Wilfong, Jr.; Wade Fletcher, both of Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/559,951

(22) Filed: Apr. 27, 2000

(51) Int. Cl.[7] ..... B65D 33/01

(52) U.S. Cl. ..... 206/554; 383/9; 383/103; 383/110

(58) Field of Search ..... 206/554, 484, 206/484.2; 383/9, 10, 37, 102, 103, 110, 119

(56) References Cited

U.S. PATENT DOCUMENTS

| | | | | |
|---|---|---|---|---|
| Re. 33,264 | | 7/1990 | Baxley et al. . | |
| 2,697,832 | | 12/1954 | Stich . | |
| 3,085,608 | | 4/1963 | Mathues . | |
| 3,097,787 | | 7/1963 | Schur . | |
| 3,399,822 | | 9/1968 | Kugler . | |
| 3,432,087 | | 3/1969 | Costello . | |
| 3,507,443 | | 4/1970 | Gerard . | |
| 4,141,487 | | 2/1979 | Faust et al. . | |
| 4,317,792 | | 3/1982 | Raley et al. . | |
| 4,456,570 | | 6/1984 | Thomas et al. . | |
| 4,491,959 | | 1/1985 | Loefberg . | |
| 4,497,431 | | 2/1985 | Fay . | |
| 4,503,561 | | 3/1985 | Bruno . | |
| 4,535,020 | | 8/1985 | Thomas et al. . | |
| 4,573,203 | | 2/1986 | Peppiatt . | |
| 4,576,316 | | 3/1986 | Foster . | |
| 4,676,373 | | 6/1987 | Schneider . | |
| 4,698,226 | | 10/1987 | Guthrie . | |
| 4,741,909 | | 5/1988 | Guthrie . | |
| 4,759,639 | * | 7/1988 | DeMatteis | 206/554 |
| 4,978,231 | | 12/1990 | Ling et al. . | |
| 4,995,860 | * | 2/1991 | Wilfong, Jr. | 206/554 |
| 5,114,766 | | 5/1992 | Jacques . | |
| 5,335,788 | | 8/1994 | Beasley et al. . | |
| 5,350,239 | | 9/1994 | Strand et al. . | |
| 5,362,152 | | 11/1994 | Fletcher et al. . | |
| 5,405,561 | | 4/1995 | Dais et al. . | |
| 5,492,705 | | 2/1996 | Porchia et al. . | |
| 5,554,250 | | 9/1996 | Dais et al. . | |
| 5,564,223 | | 10/1996 | Takita . | |
| 5,576,037 | * | 11/1996 | Moore, Jr. et al. | 383/9 |
| 5,845,779 | * | 12/1998 | Wilfong, Jr. et al. | 206/554 |
| 5,881,882 | * | 3/1999 | Fletcher et al. | 206/554 |
| 5,919,504 | | 7/1999 | Muise et al. . | |
| 6,030,120 | * | 2/2000 | Fox et al. | 383/9 |
| 6,113,269 | * | 9/2000 | DeMatteis et al. | 383/10 |

FOREIGN PATENT DOCUMENTS

| | | |
|---|---|---|
| 113542 | 7/1941 | (AU) . |
| 230565 | 12/1963 | (AU) . |
| 639709 | 4/1962 | (CA) . |
| 1 201 537 B29 | 9/1965 | (DE) . |
| 26 14 899 A1 | 10/1977 | (DE) . |
| 28 02 849 A1 | 7/1978 | (DE) . |
| 28 07 162 A1 | 8/1978 | (DE) . |
| 886612 | 1/1962 | (GB) . |
| 2 141 688 A | 1/1985 | (GB) . |
| 2 221 691 A | 2/1990 | (GB) . |

* cited by examiner

*Primary Examiner*—Luan K. Bui
(74) *Attorney, Agent, or Firm*—Alston & Bird LLP

(57) ABSTRACT

A ventilated plastic bag particularly adapted for carrying hot food from fast food restaurants includes the following components. Front and rear wall sections are connected together to define a closed bottom area and an open top area. A handle or handles are provided in the top area and include a cut out of the front and rear wall sections creating reduced strength regions with resulting high potential for carrying around at least part of the cut out. Closely spaced micro-perforations extend through the wall sections in at least a major portion of the plastic bag other than the reduced strength regions to provide ventilation to an interior food carrying area of the plastic bag while not further weakening the reduced strength regions and increasing the potential for tearing of the bag.

24 Claims, 6 Drawing Sheets

VENTILATED PLASTIC BAG

FIELD OF THE INVENTION

This invention relates to a ventilated plastic bag particularly adapted for carrying hot food from fast food restaurants, a pack of such bags, and a dispensing system utilizing such bags.

BACKGROUNG OF THE INVENTION

Since the 1970's, plastic bags have been replacing paper bags in the United States for the grocery and retail products industries because of the superior strength and inherent moisture resistant properties and strength of plastic, among other things.

These plastic bags have taken various shapes and forms including T-shirt type plastic bags which include front and rear wall sections integrally connected together by gussetted side walls and connected at the bottom to define a closed bottom on the bag. At least a part of the top of the front and rear wall sections are open at the tops to define an open mouth and laterally spaced handles which are integral with the wall sections extend upwardly from opposed sides of the mouth portions for carrying of the bags. This type of plastic bag is illustrated assignee's prior U.S. Pat. No. 4,676,373 (the disclosure of which is incorporated herein by reference).

Other types of plastic bags include what is known in the industry as a die-cut handle bag which has front and rear wall sections preferably connected by gussetted side wall sections integrally extending therefrom and positioned therebetween and wherein the bottom of the bag is closed and the top of the bag is open. These die-cut handle bags include a cut out hole, preferably of a kidney-shape, positioned generally centrally of a top area of the bag for receiving fingers of the user for carrying of the bag. Other bag constructions have been proposed with handle means provided in top areas of the bag formed by a cut out of front and rear wall sections.

All of these bags are usually utilized in a pack of a plurality of bags and in a dispensing system in which the bag pack is mounted in generally vertically suspended position for successive removal of the bags by a user.

Notwithstanding the success of plastic bags and replacement of plastic bags in the grocery and retail products industries, paper bags have for the most part continued to be used in the fast food restaurant industry for packaging and carrying hot foods. There are a number of problems associated with the use of such paper bags in the fast food restaurant industry, including the difficulty in handling of the paper bags, the inherent opaque nature of the paper bags resulting in the inability to see the hot food items packaged in the bag and resulting mistakes in filling customers' orders, the inherent weaknesses in the bags when they become moist or the like, etc. On the other hand, plastic bags have not been used for packaging and transporting hot foods in the fast food restaurant industry primarily because of the problem which occurs with moisture collecting on the insides of the plastic bag when filled with hot foods. This moisture will condensate and cause the food to get soggy and will wet the hand of the user when reaching into the bag.

In an attempt to overcome this problem with the use of plastic bags in the fast food restaurant industry, a T-shirt type plastic bag for carrying hot foods was developed, as illustrated and described in assignee's prior U.S. Pat. No. 5,362,152 (the disclosure of which is incorporated herein by reference). The T-shirt type plastic bag of this prior patent provided apertures extending through at least one of the wall sections of the bag for providing a path for venting air flow from the outside of the bag and through the inside of the bag when the bag is carrying hot food. The apertures comprise a generally semi-circular shaped cut out defining a flap portion which opens up to produce a generally half moon-shaped aperture. These C-shaped apertures were preferably spaced about 2½" to 3" apart and were of relatively large sizes to allow the above-described flow of air.

While this ventilated plastic bag construction of assignee's prior U.S. patent overcame some of the previous problems presented with paper bags and provided a plastic bag construction which could be utilized by the fast food restaurant industry, it did not sufficiently prevent condensation within the bag. Because of the size of the C-shaped vent apertures, a spacing of 2" to 3" apart was necessary to preserve the strength of the bag. However, this created dead zones within the bag with no airflow and thus did not sufficiently prevent condensation from forming on the inside of the bag.

OBJECT AND SUMMARY OF THE INVENTION

Accordingly, it is the object of this invention to provide a ventilated plastic bag which is particularly adapted for carrying hot foods from fast food restaurants and which will overcome the problems discussed above.

By this invention it has been found that the above object may be accomplished by providing a ventilated plastic bag comprising any desired construction including at least front and rear wall sections connected together to define a closed bottom area and an open top area and handle means in the top area which is at least partially formed by a cut out of the front and rear wall sections resulting in reduced strength regions with resulting high potential for tearing in the front and rear wall sections around at least a part of the cut out. Closely spaced micro-perforations extend through the wall sections in at least a major portion of the plastic bag to provide desired ventilation to an interior food carrying area of the plastic bag.

Micro-perforations have been utilized in plastic bags for purposes other than in the fast food industry, i.e. plastic bags with micro-perforations have been utilized for holding loafs of bread and have been utilized with zip-lock bags for containing vegetables or the like food products. In these bags, the pattern of micro-perforations consumed substantially the entire surface areas of the bags.

Micro-perforations in a plastic bag to be utilized in the fast food industry would have two primary, yet sometimes conflicting purposes. These are to prevent condensation within the bag and to keep the food in the bag warm. Closely spaced micro-perforations provide virtually 100% venting coverage in the food carrying portion of the bag while keeping the food warm in the bag. By placing small perforations close together, all surface areas of the bag having the perforations are subjected to a small airflow from the natural convection created to prevent condensation from forming on the inside surface of the bag. The micro-perforations, as opposed to large vent openings, keep the food warmer while providing desired ventilation. However, it has been determined by this invention that these closely spaced micro-perforations tend to weaken the resistance to tear in the bag and if placed along substantially the entire surface area (as had been done in prior micro-perforated plastic bread and vegetable bags) and in the reduced strength regions created by the cut out utilized to form the handle means in the bag, and create greater tear propagation providing problems in use of the bags. Therefore, in accordance with this invention the closely spaced micro-perforations are positioned in a major portion of the plastic bag other than the reduced strength regions to provide the desired ventilation to an interior food carrying area of the bag while not further weakening the reduced strength regions of the bag and increasing the potential for tearing.

The ventilated plastic bag of this invention may be of the T-shirt type having a generally U-shaped cut out in the top area of the bag to produce laterally spaced handles extending upwardly from the top area of the bag, or it may be of the type having a cut out defining a hole of sufficient size in generally a central area of the open top area of the bag for receiving fingers of the user and to function as a handle. This hole may preferably be kidney-shaped. Other types of plastic bags having handles including cut out portions of the front and rear wall sections may be utilized in the invention of the present application.

The reduced strength regions caused by the cut out of the handle means of the bag typically extends completely around a cut out hole in that type of bag and generally at the corners of a U-shaped cut out utilized in a T-shirt style bag. The closely spaced micro-perforations may extend in horizontal rows across the entire width of the bag and only below the reduced strength regions created by the cut out of the wall sections, or the closely spaced micro-perforations may extend in vertical rows along the entire length of the bag and only on each side of the reduced strength section regions created by the cut out of the wall sections. The micro-perforations preferably are about 1/32" in diameter and are preferably spaced apart approximately 1/4". Other patterns, spacings and sizes may be used which accomplish the desired objectives of the present invention.

By overcoming ventilation and strength problems in plastic bags proposed by use in the fast food industry, it has also been found by this invention that other preferred features of plastic bags heretofore utilized in other contexts can also be utilized with the ventilated plastic bag of this invention. These improvements include the use of non-residue central mounting tab portions on the bags for adapting the bags for mounting on a suitable dispenser rack for removal by a user without leaving residue on the rack, self-opening features which allow the bags to be serially opened one at a time by the user when removing the bags from a rack, angle seals at the bottom corners of the bag to produce a flat bag when the bag is in an open position for loading by a user, etc. It has also been found desirable to utilize either clear film to enable identification of articles placed inside the bag for a more accurate order filling in the fast food restaurant or co-extruded film in which an inside layer of film is of a stiffer material to provide shape to the bag and an outside layer is of a softer film material to enhance corona and pressure bonding between outside layers for self-opening of the bags when serially removed one at a time from a bag pack mounted on a dispensing rack.

Other features may also be combined with the novel ventilated plastic bag of this invention to provide synergistic results.

BRIEF DESCRIPTION OF THE DRAWINGS

Some of the objections and advantages of the invention having been set forth, other objects and advantages will appear from the following Detailed Description Of Preferred Embodiments Of The Invention, when taken in conjunction with the accompanying drawings, in which.

DETAILED DESCRIPTION OF PREFERRED EMBODIMENTS OF THE INVENTION

Figure 1:
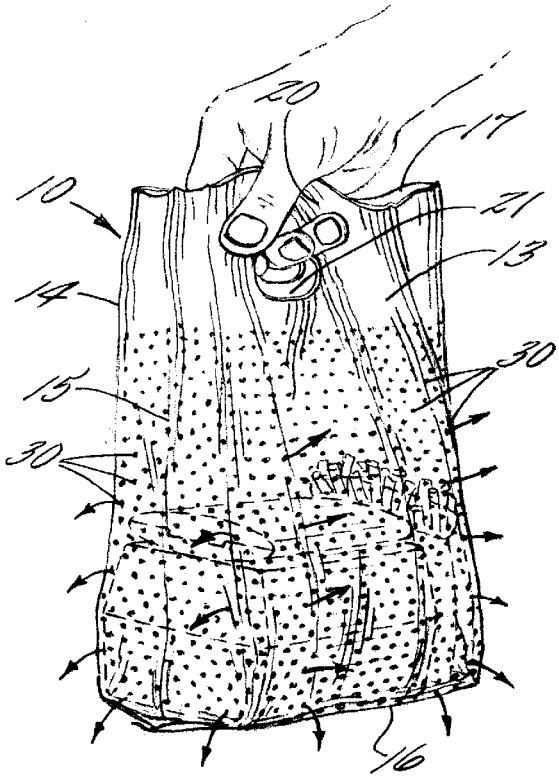
FIG. 1 is a perspective view of a first embodiment of a ventilated plastic bag constructed in accordance with this invention, loaded with hot food from a fast food restaurant and being carried at a handle section by a user.
Figure 2:
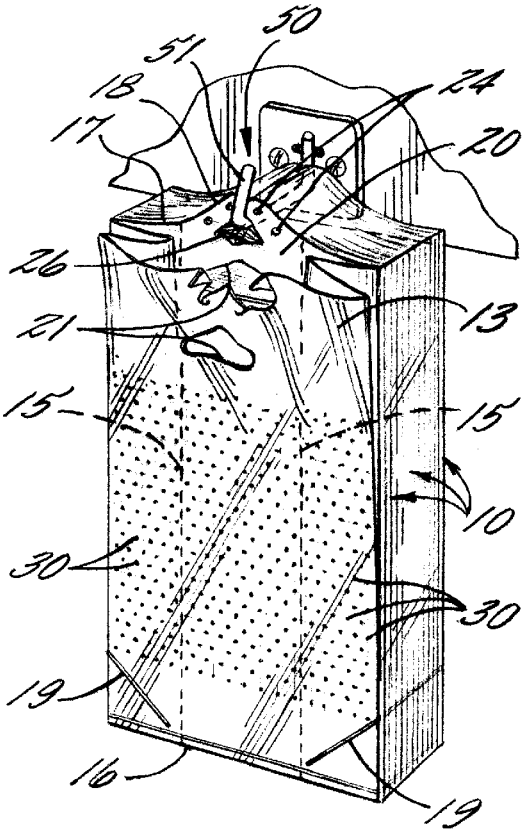
FIG. 2 is a perspective view of a pack of the plastic bags of the first embodiment of FIG. 1 and having a first pattern of closely spaced micro-perforations and being mounted on a rack for removal by a user and filling with hot food from a fast food restaurant.
Figure 4:
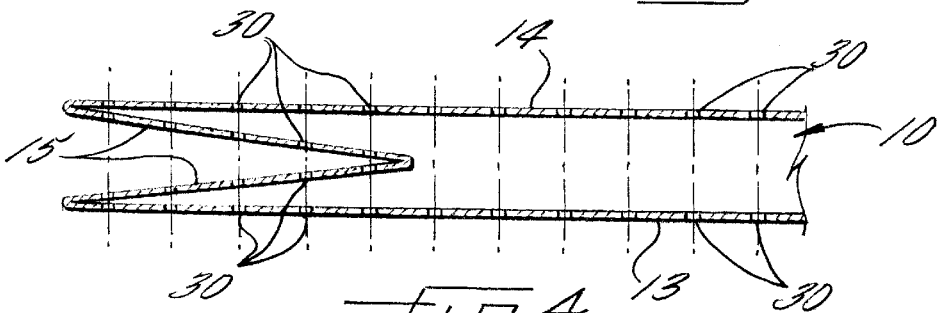
FIG. 4 is a sectional view through the plastic bag of the first embodiment of FIG. 3 and taken generally along the line 4—4 of FIG. 3.
Figure 3:
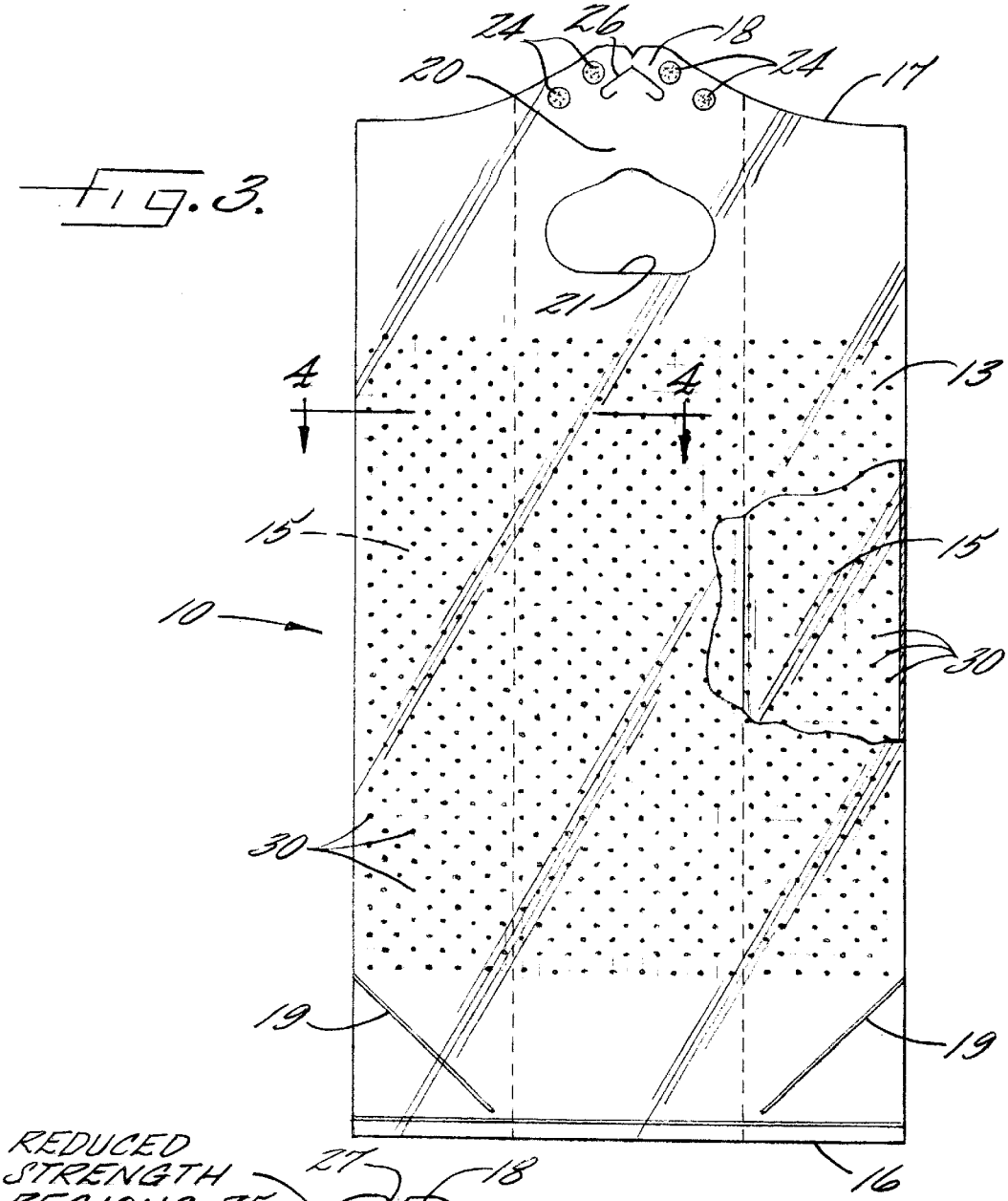
FIG. 3 is an enlarged front elevational view, partially broken away, of one of the plastic bags of the first embodiment illustrated in FIG. 2.

Referring now to the drawings, there are shown two embodiments of ventilated plastic bags, generally indicated at 10, in FIGS. 1–8 and FIGS. 9–11, respectively, which are particularly adapted for use in carrying hot food from fast food restaurants.

Each of these embodiments of plastic bags 10 include at least front and rear wall sections 13, 14 connected together to define a closed bottom area 16 and an open top area 17, and handle means 20 provided in the top area 17 and which is at least particularly found by a cut-out 21 of the front and rear wall sections 13, 14 creating reduced strength regions 25 with resulting high potential for tearing in the front and rear wall sections 13, 14 around at least a part of the cut-out 21. Closely spaced micro-perforations 30 extend through the wall sections 13, 14 in at least a major portion of the plastic bag 10 other than the reduced strength regions 25 to provide ventilation to an interior food carrying area of the plastic bag 10 (as illustrated in FIG. 1), while not further weakening the reduced strength regions 25 and increasing the potential for tearing of the bag 10.

Preferably, both of the embodiments of ventilated plastic bags 10 illustrated in FIGS. 1–8 and FIGS. 9–11, respectively, further include gussetted side wall sections 15 integrally connecting the front and rear wall sections 13, 14 together and being positioned between these sections at side areas of the bag 10 in its closed position (as illustrated in FIGS. 2–10).

These plastic bags 10 may be constructed of any suitable material including high-density polyethylene film material well known in the industry for use in plastic bags. Preferably, the plastic bags 10 may be constructed of a clear film material, such as the polyolefin films normally used in plastic bag manufacture, i.e. low density, linear low density, medium density, high density polyethylene or film grade polypropylene. These films are produced from non-pigmented or natural resin which is inherently non-opaque. The degree of film clarity will depend upon the type and density of resin used, however, all polyolefin films are sufficiently clear to allow the construction of bags which are relatively transparent. The advantage of a clear film bag for fast food packaging are manifested in more accurate order filling and by allowing the customer to readily inspect their order when packaged in the bags. The increased order accuracy and visual inspection by the customer allows for faster overall service and efficiency at the drive-through window of fast food restaurants.

A preferred embodiment of a clear film ventilated plastic bag 10 would be the use of a primary high-density polyethylene resin film because of its superior stiffness, cost and processability. Polypropylene has a slightly higher tensile modulus, 165–200 kpsi, than high-density polyethylene, but is more difficult to process into bags and has a higher cost. Typical film grade high molecular weight, high-density polyethylene has a density in the range of 0.945–0.955 gm/cu cm and a tensile modulus value of 150–160 kpsi. Typical film grade low density polyethylene and linear low density polyethylene have a density range of 0.915–0.925 gm/cu cm and a modulus of 25–75 kpsi. The preferred film would be manufactured from a commercial grade of high density polyethylene, such as Exxon HDZ-152 which has a density of 0.950 gm/cu cm, a modulus of 150 kpsi in an average thickness of between 15–25 microns. Value for density and tensile modulus are from the 1998-1999 volume of Plastic Technology—Manufacturing Handbook And Buyers Guide.

The closed bottom area 16 of the bag 10 may be formed by heat sealing of the film material utilized to form the bag 10 or in any conventional manner. This closed bottom area 16 may also include corner or angle seals 19 formed by heat sealing and extending across corners of the bag 10 and through the front and rear wall sections 13, 14 and the intermediate gussetted side wall sections 15 to define a square bottom on the bag 10 when the bag is in an open position in a manner well understood by those with skill in the art.

Figure 5:
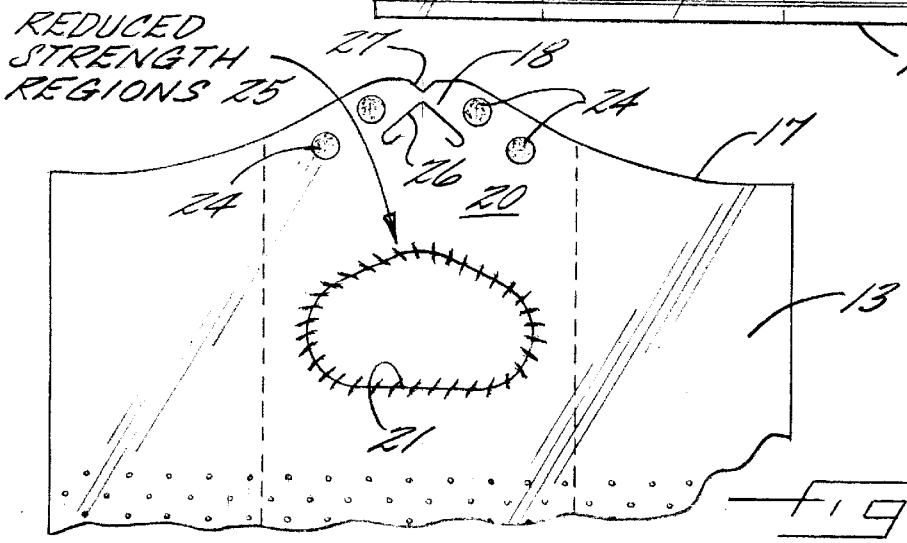
FIG. 5 is an enlarged front elevational view of the top area of the first embodiment of ventilated plastic bag of FIG. 3 and schematically illustrating reduced strength regions created by the cut out of the front and rear wall sections to create a handle means in the plastic bag.

Referring now specifically to the first embodiment of a ventilated plastic bag 10 as shown in FIGS. 1–8, this bag 10 utilizes a handle means 20 which includes a cut out 21 defining a hole of sufficient size to receive fingers of a user (as shown particularly in FIG. 1). This hole formed by the cut out 21 is preferably generally kidney-shaped and is positioned generally centrally of the top area 17 and between the gussetted side walls 15 of the bag 10. This cut out 21 creates reduced strength regions 25 around the hole created by the cut out 21 (as schematically shown in FIG. 5) which results in a higher potential for tearing.

Figure 9:
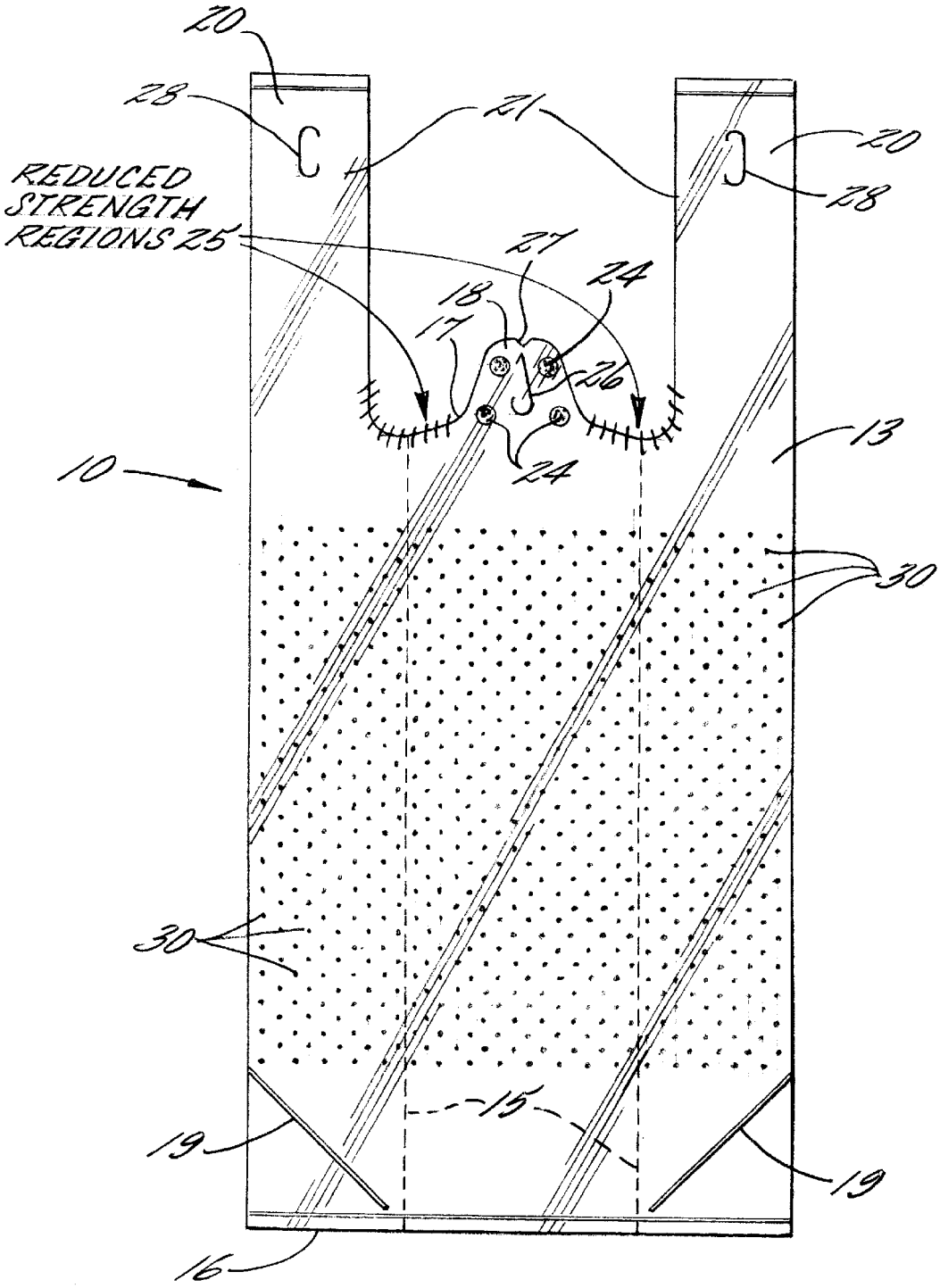
FIG. 9 is a front elevational view of a second embodiment of a ventilated plastic bag of the T-shirt type construction and having the first pattern of closely spaced micro-perforations.
Figure 10:
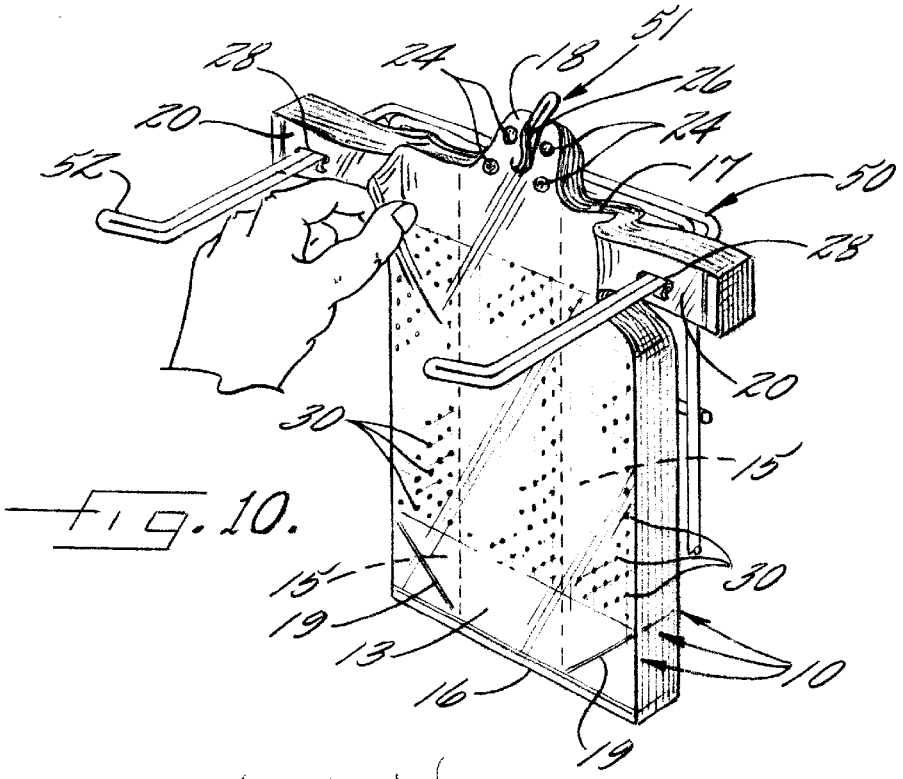
FIG. 10 is a perspective view of a pack of the bags of FIG. 9 mounted on a dispensing rack.
Figure 11:
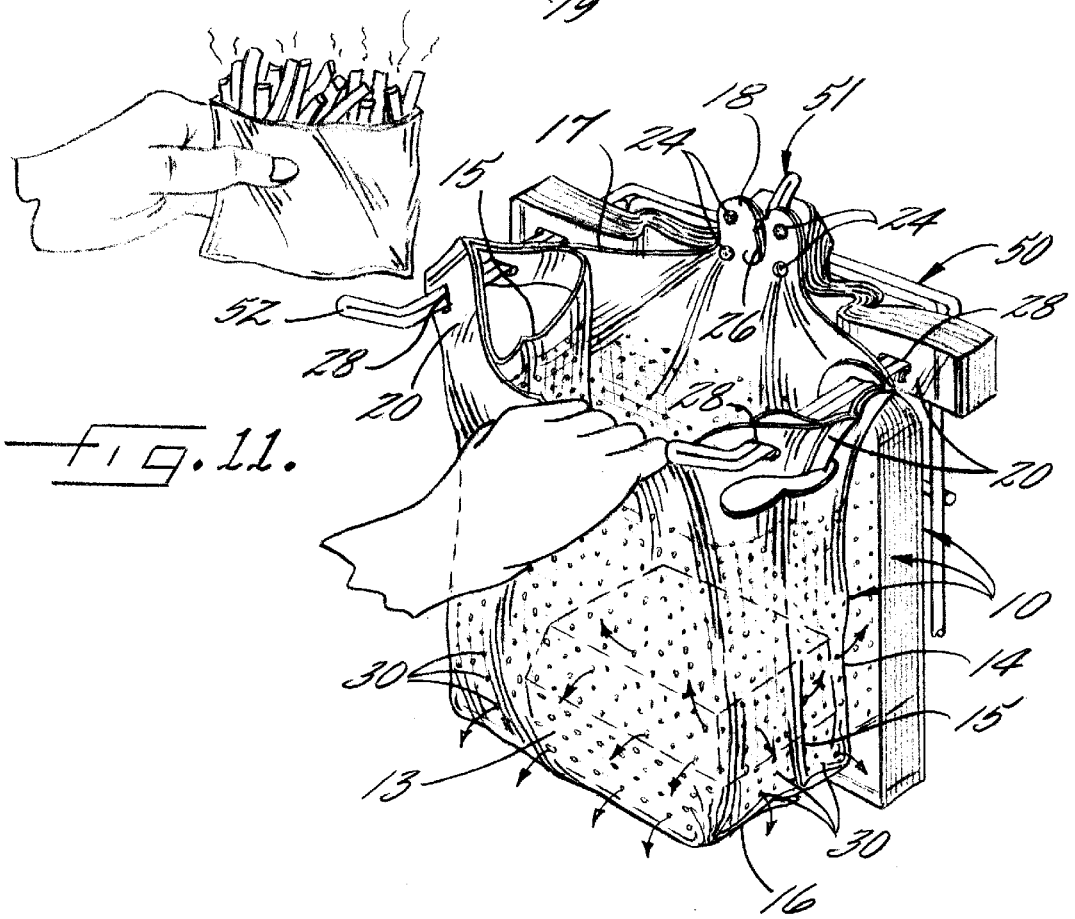
FIG. 11 is a view like FIG. 10 illustrating a first bag being opened on said rack for filling by a user and subsequent removal for serially opening the next bags in the pack on the rack.

Referring now to the second embodiment of ventilated plastic bag 10 illustrated in FIGS. 9–11, this bag includes laterally spaced handles 20 integral with the front, rear and gussetted side wall sections 13, 14, 15 and extending upwardly from the open top area 17 of the bag 10. These handles 20 are formed by a generally U-shaped cut out 21 of the front, rear and gussetted side wall sections 13, 14, 15 (as shown in FIG. 9) which creates reduced strength regions 25 with resulting high potential for tearing around at least part of the cut out 21 (as schematically indicated in FIG. 9).

The reduced strength regions 25 of the first embodiment of ventilated plastic bag 10 of FIGS. 1–8 (which is created by the cut out 21 forming a hole in the top area of the bag 10 and which is preferably kidney-shaped) extends completely around the cut out 21 hole forming part of the handle 20 (as indicated in FIG. 5). In the second embodiment of a T-shirt type ventilated plastic bag of FIGS. 9–11, the reduced strength regions 25 are located generally at the corners of the U-shaped cut out 21 (as indicated in FIG. 9).

Figure 6:
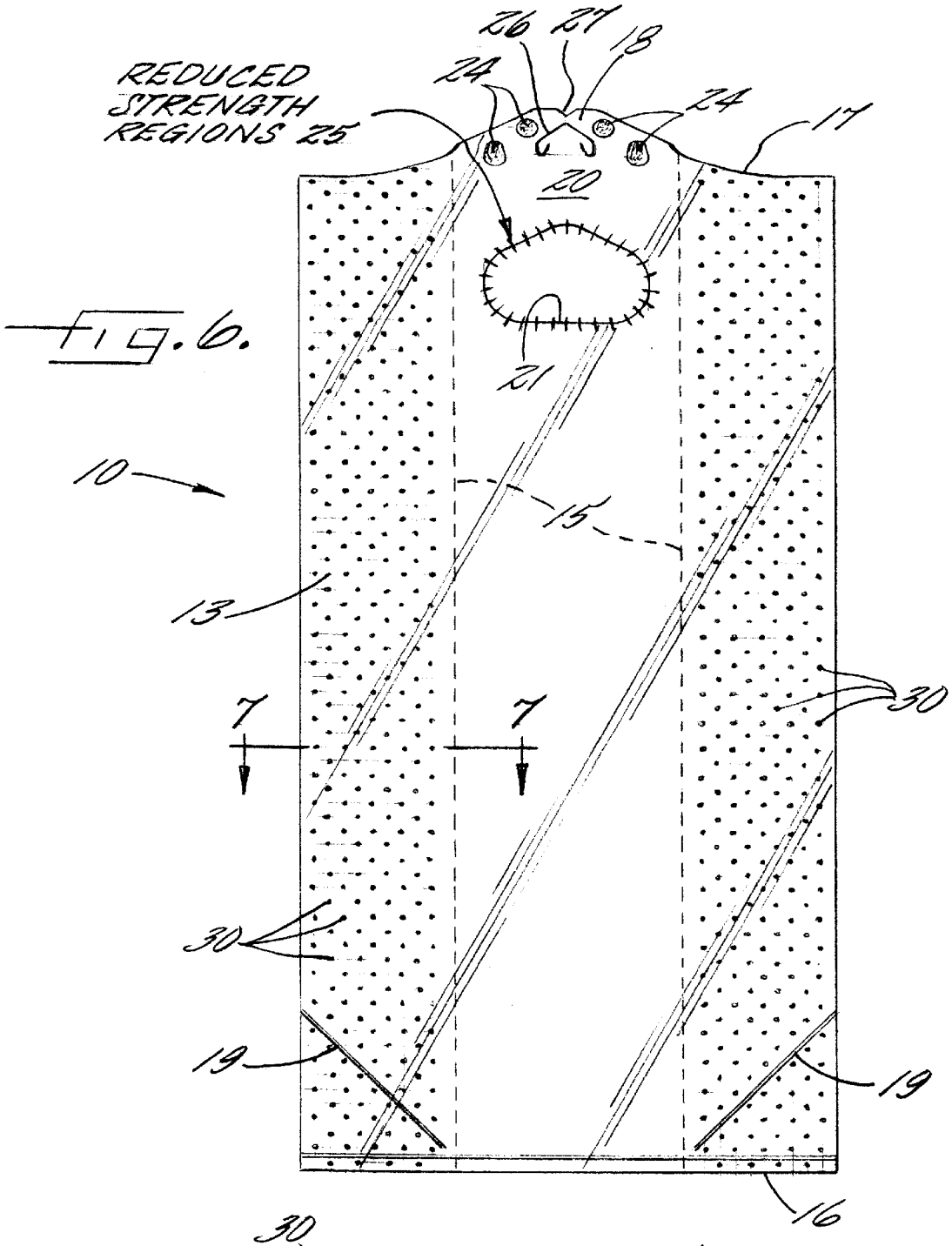
FIG. 6 is a view, like FIG. 3, illustrating a different pattern of closely spaced micro-perforations.
Figure 7:
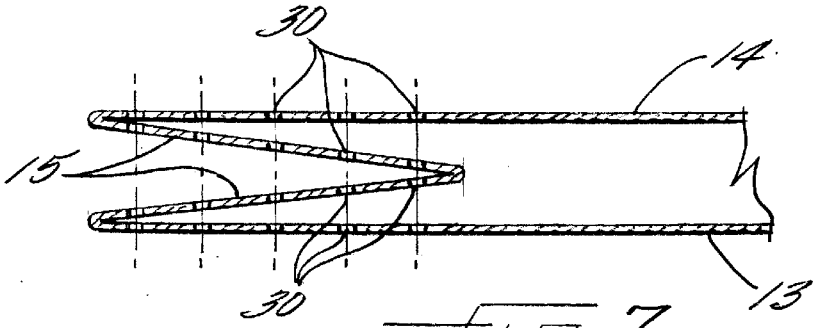
FIG. 7 is a sectional view, taken generally along the lines 7—7 of FIG. 6.

The closely spaced micro-perforations 30 may extend in horizontal rows across the entire width of the bag 10 and only below the reduced strength regions 25 created by the cut out 21 of the wall sections 13, 14, 15 (as shown in FIGS. 1–5 and 8–11). Alternatively, the closely spaced micro-perforations 30 may extend in vertical rows along the entire length of the bag 10 and only on each side of the reduced strength regions 25 created by the cut out 21 of the wall sections 13, 14, 15 (as shown in FIGS. 6 and 7). This latter pattern of closely spaced micro-perforations 30 may also be utilized in the second embodiment of a T-shirt style plastic bag 10 of FIGS. 9–11. Preferably, the closely spaced micro-perforations 30 in either pattern are spaced apart approximately ¼" and are approximately 1/32" in diameter.

Either embodiment of ventilated plastic bags 10 are preferably connected together to form a pack of a plurality of such bags 10 (as shown in FIGS. 2, 8, 10 and 11). These packs of bags 10 may be mounted on suitable racks 50 (as shown in FIGS. 2, 8, 10 and 11). For this purpose, each of the bags 10 includes a detaching central mounting tab portion 18 having an aperture 26 therein for mounting on an elongate generally horizontally extending central tab retaining device 51 on the rack 50. This detaching central mounting tab portion 18 may be constructed in accordance with the teachings of assignee's U.S. Pat. Nos. 5,845,779 and 5,881,882 (the disclosure of which are incorporated herein by reference) to provide a detaching central mounting tab portion 18 which is adapted to leave no residue on the rack 50 as the bags 10 are successively removed one at a time from the rack 50 for use by a user. The T-shirt type plastic bag 10 of FIGS. 9–11 also includes apertures 28 in the handles 20 for slideably mounting the bag handles 20 on arms 52 on the rack 50 for purposes well known to those with skill in the art. Additionally, there is provided a means, such as a knick 27, in the tab portion 18 for propagating a tear through the tab portion 18 from the aperture 26 to ensure that no bag residue is left on the dispensing rack 50 or the tab retaining device 51 as disclosed in the above mentioned U.S. Pat. Nos. 5,845,779 and 5,881,882.

Figure 8:
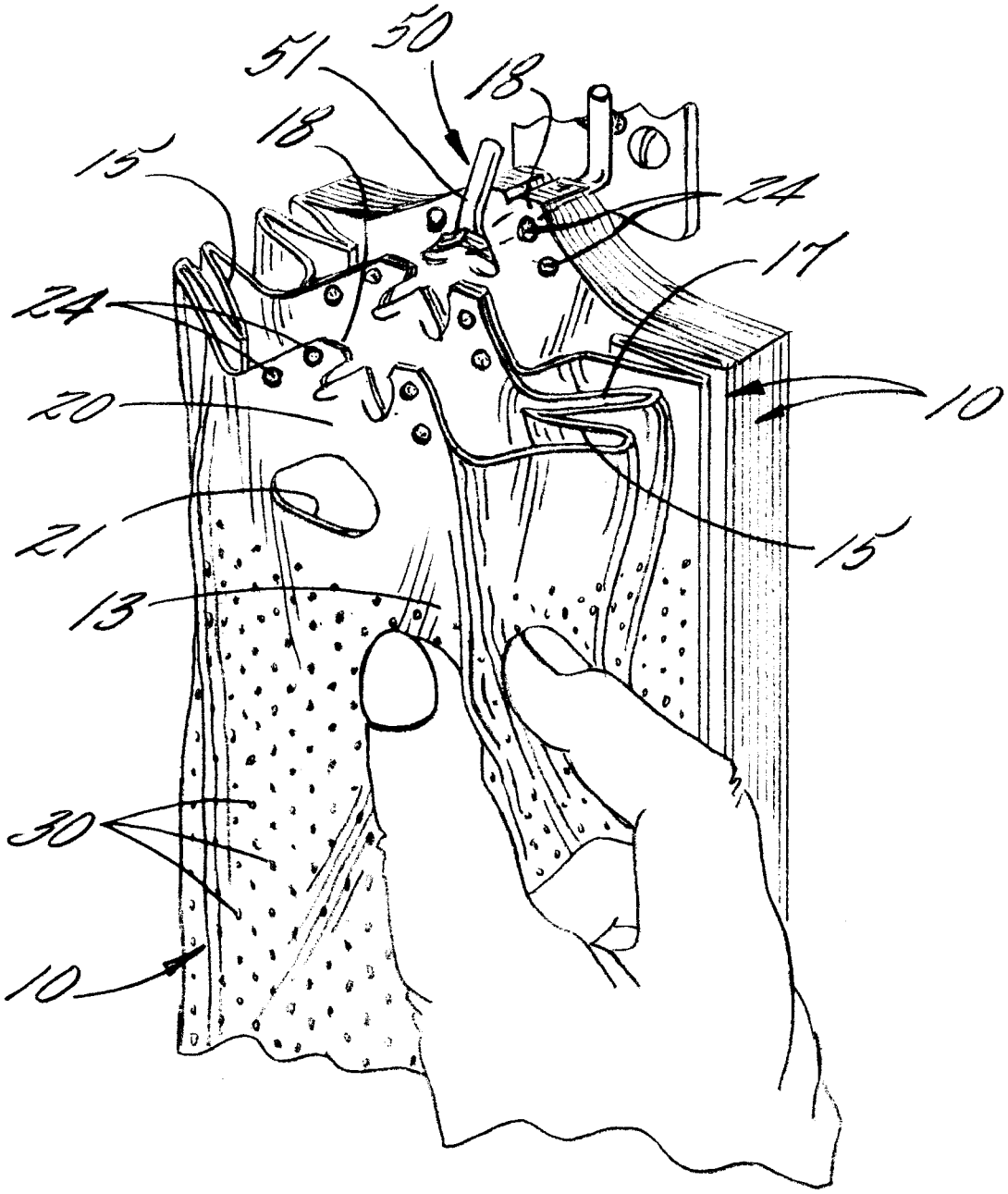
FIG. 8 is a perspective view of the bag pack of FIG. 2 mounted on a dispensing rack and showing the bags being serially removed one at a time from the rack.

It has also been found that it is preferable to incorporate into the pack of plastic bags 10 of this invention the easy-open, self-opening features set forth in assignee's prior U.S. Pat. No. 5,335,788 (the disclosure of which is incorporated herein by reference). For this purpose, each of the bags 10 in the pack are connected together by suitable compression areas 24 which extend transversely through the bag pack in the upper portions of the bags such that the bag pack has decreased thickness in the compression area. The outer surfaces of the front and rear wall sections 13, 14 are corona treated (as fully disclosed in this prior patent) so that the corona treated outer surfaces of the front and rear wall sections 13, 14 in the localized compressed areas 24 are substantially releasably adhered together and adjacent inside surfaces of the front and rear wall sections 13, 14 in the compressed areas 24 which are not corona treated are not substantially adhered together. This construction provides self-opening bags in the pack as the bags 10 are serially removed from the rack 50, as shown in FIGS. 8 and 11 and as disclosed in the above mentioned U.S. Pat. 5,335,788.

In this regard, it has been determined that corona induced pressure bonding for self-opening is easier to create with lower density film materials. It is believed that this is because of the inherent softness and molecular structure of these lower density film materials. However, in construction of plastic bags for packaging hot foods, stiffness of the bag is also a significant concern. Stiffness is important to make the bag stand-up and have shape to package the food in an orderly fashion. Stiffness also aids in venting of the bag by maintaining the top in an open configuration. If the bag walls collapse, venting air flow will be restricted and will increase the likelihood of condensation of moisture within the bag. Film stiffness is determined primarily by the thickness of the film and the modulus properties of the particular resin being used to construct the film. Of these two factors, thickness has the greatest influence but unfortunately also carries the highest cost, i.e. thicker bags equal more material equal higher price. Therefore, the requirement for a stiff bag and a bag that will self-open have somewhat conflicting requirements.

A suitable film structure which would meet these requirements has found to be a co-extruded film structure including an inner layer of stiff material such as high molecular weight, high density polyethylene or polypropylene and a softer outer layer such as low density polyethylene or linear low density polyethylene. Typical co-extruded structures consist of 70–75% of the total thickness coming from the inner layer and 25–30% of the total thickness coming from the outer layer. The preferred embodiment for this application to maximize stiffness and corona pressure bonding would be an inner layer of high molecular weight, high density polyethylene, such as commercial grade Exxon HDZ-152, at 75% of the total thickness, and an outer layer of linear low density polyethylene, such as Exxon LL-1108, at 25% of the total thickness. While this has been determined to be the preferred embodiment of co-extruded film for optimizing both stiffness and self-opening, other combinations of co-extruded film structures are certainly possible to meet the objectives of this invention.

In the drawings and specification there have been set forth preferred embodiments of this invention, and although specific terms are employed, they are used in generic and descriptive sense only and not for purposes of limitation, the scope of the invention is defined in the following claims.

What is claimed is:

1. A ventilated plastic bag particularly adapted for carying hot food from fast food restaurants and constructed of a co-extruded film structure in which one of the layers thereof is a relatively soft material and the other layer thereof is a stiff material and in which the stiff material layer is positioned on the inside of said bag, said bag comprising:

front and rear wall sections connected together to define a closed bottom area and an open top area;

handle means provided in said top area and at least partially formed by a cut out of said front and rear wall sections creating reduced strength regions with resulting high potential for tearing in said front and rear wall sections around at least part of said cut out; and closely spaced micro-perforations extending through said wall sections in at least a major portion of said plastic bag other than said reduced strength regions to provide ventilation to an interior food carrying area of said plastic bag while not further weakening said reduced strength regions and increasing the potential for tearing.

2. A ventilated plastic bag particularly adapted for carrying hot food from fast food restaurants and constructed of a co-extruded film structure in which one of the layers thereof is a relatively soft material and the other layer thereof is a stiff material and in which the stiff material layer is positioned on the inside of said bag, said bag comprising:

front and rear wall sections connected together to define a closed bottom area and an open top area;

handle means provided in said top area and at least partially formed by a cut out of said front and rear wall sections defining a hole of sufficient size to receive fingers of a user and creating reduced strength regions with resulting high potential for tearing in said front and rear wall sections around at least part of said cut out; and closely spaced micro-perforations extending through said wall sections in at least a major portion of said plastic bag other than said reduced strength regions to provide ventilation to an interior food carrying area of said plastic bag while not further weakening said reduced strength regions and increasing the potential for tearing.

3. A ventilated plastic bag, as set forth in claim 2, in which said bag further includes gussetted side wall sections integrally connecting said front and rear wall sections together and being positioned therebetween at side areas of said bag, and in which said cut out hole is positioned generally centrally of the top area and between the side areas of said bag and extends only through said front and rear wall sections.

4. A ventilated plastic bag, as set forth in claim 3, in which said reduced strength regions extend completely around said cut out hole.

5. A ventilated plastic bag of the T-shirt type and particularly adapted for carrying hot food from fast food restaurants and constructed of a co-extruded film structure in which one of the layers thereof is a relatively soft material and the other layer thereof is a stiff material and in which the stiff material layer is positioned on the inside of said bag, said bag comprising:

front and rear wall sections, gussetted side wall sections integrally connecting said front and rear wall sections together to define an open top area in said bag, means connecting bottoms of said front, rear and gussetted side wall sections together to define a closed bottom area;

laterally spaced handles integral with said front, rear and gussetted side wall sections and extending upwardly from said open top area of said bag and being at least partially formed by a generally U-shaped cut out of said front, rear and gussetted wall sections creating reduced strength regions with resulting high potential for tearing in said front and rear wall sections around at least part of said cut out; and closely spaced micro-perforations extending through said wall sections in at least a major portion of said plastic bag other than said reduced strength regions to provide ventilation to an interior food carying area of said plastic bag while not further weakening said reduced strength regions and increasing the potential for tearing.

6. A ventilated plastic bag, as set forth in claim 5, in which said reduced strength regions are located generally at the corners of said U-shaped cut out.

7. A ventilated plastic bag, as set forth in claim 1, 2, 3, 4, 5 or 6, in which said closely spaced micro-perforations extend in horizontal rows across the entire width of said bag and only below said reduced strength regions created by said cut out of said wall sections.

8. A ventilated plastic bag, as set forth in claim 7, in which said micro-perforations are approximately 1/32" in diameter and are spaced apart approximately 1/4".

9. A ventilated plastic bag, as set forth in claim 1, 2, 3, 4, 5 or 6, in which said closely spaced micro-perforations extend in vertical rows along the entire length of said bag and only on each side of said reduced strength regions created by said cut out of said wall sections.

10. A ventilated plastic bag, as set forth in claim 9, in which said micro-perforations are approximately 1/32" in diameter and are spaced apart approximately 1/4".

11. A ventilated plastic bag, as set forth in claim 1, 2, 3, 4, 5 or 6, in which said bag further includes a detaching central mounting tab portion extending upwardly from a central area of said front and rear wall sections at said open top area to adapt said bag for mounting on a suitable dispensing rack for removal by a user.

12. A ventilated plastic bag, as set forth in claim 11, in which mounting tab portion includes an aperture for mounting said bag on an arm of a suitable dispensing rack, and includes means for propagating a tear through said tab portion from said aperture to ensure that no bag residue is left on the dispensing rack when said bag is removed by a user.

13. A ventilated plastic bag, as set forth in claim 11, in which said bag is constructed of a clear polyolefin film produced from non-pigmented or natural resin which is inherently non-opaque.

14. A pack of ventilated plastic bags, as set forth in claim 11, in which of said bags comprises polyethylene film, in which at least an upper portion of an outer surface of said front and rear wall sections of each of said bags is corona treated, and in which at least one localized compressed area extends transversely through said bag pack in said upper portion of said bags such that said pack has a decreased thickness in said compressed area, wherein adjacent outer corona treated surfaces of said front and rear wall sections defined by said localized compressed areas are substantially releasably adhered together and adjacent inside surfaces of said front and rear wall sections defined by said localized compressed area are not substantially adhered together for providing a self-opening bag pack as said bags are serially removed from the rack.

15. A ventilated plastic bag, as set forth in claim 3, 4, 5 or 6, in which said bag further includes corner seals extending across corners of said bag at said closed bottom area and extending through said front and rear wall sections and said intermediate gussetted side wall sections to define a square bottom on said bag when said bag is in an open position.

16. A ventilated plastic bag dispensing system comprising:

a pack of ventilated plastic bags, each bag constructed as set forth in claim 11; and a rack for supporting said pack of plastic bags in a generally vertical suspended position for successive removal of said bags from said pack by a user and including an elongate generally horizontally extending central tab retaining device for receiving said detaching central mounting tab portion of each of said bags in said pack.

17. A ventilated plastic bag dispensing system, as set forth in claim 16, in which said closely spaced micro-perforations extend in horizontal rows across the entire width of said bag and only below said reduced strength regions created by said cut-out of said wall sections.

18. A ventilated plastic bag dispensing system, as set forth in claim 17, in which said micro-perforations are approximately 1/32" in diameter and are spaced apart approximately 1/4".

19. A ventilated plastic bag dispensing system, as set forth in claim 16, in which said closely spaced micro-perforations extend in vertical rows along the entire length of said bag and only on each side of said reduced strength regions created by said cut-out of said wall section.

20. A ventilated plastic bag dispensing system, as set forth in claim 19, in which said micro-perforations are approximately 1/32" in diameter and are spaced apart approximately 1/4".

21. A ventilated plastic bag dispensing system, as set forth in claim 16, in which said mounting tab portion includes an aperture for mounting each of said bags in said pack on said central tab retaining device of said rack, and in which said mounting tab portion includes means for propagating a tear through said tab portion from said aperture to ensure that no bag residue is left on said rack when said bags are removed by a user.

22. A ventilated plastic bag dispensing system, as set forth in claim 16, in which said bags comprise polyethylene film, in which at least an upper portion of an outer surface of said front and rear wall sections of each of said bags is corona treated and in which at least one localized compressed area extends transversely through said bag pack in said upper portion of said bags such that said pack has a decreased thickness in said compressed area, wherein adjacent outer corona treated surfaces of said front and rear wall sections defined by said localized compressed areas are substantially releasably adhered together and adjacent inside surfaces of said front and rear wall sections defined by said localized compressed areas are substantially not adhered together for providing a self-opening bag pack as said bags are serially removed from said rack.

23. A ventilated plastic bag dispensing system, as set forth in claim 10, in which each of said bags further include corner seals extending across corners of said bags at said closed bottom area and extending through said front and rear wall sections and said intermediate gussetted side wall sections to define a square bottom on said bags when said bags are in an open position.

24. A ventilated plastic bag, as set forth in claim 16, in which said bag is constructed of a clear polyolefin film produced from non-pigmented or natural resin which is inherently non-opaque.

* * * * *